United States Patent [19]

Jones, Jr. et al.

[11] 4,101,899

[45] Jul. 18, 1978

[54] COMPACT LOW-PROFILE ELECTRICALLY SMALL VHF ANTENNA

[75] Inventors: Howard S. Jones, Jr., Washington, D.C.; Frank Reggia, Bethesda, Md.

[73] Assignee: The United States of America as represented by the Secretary of the Army, Washington, D.C.

[21] Appl. No.: 748,587

[22] Filed: Dec. 8, 1976

[51] Int. Cl.[2] ..... H01E 7/08

[52] U.S. Cl. ..... 343/788; 343/830; 343/895

[58] Field of Search ..... 343/895, 788, 708, 829, 343/830

[56] References Cited

U.S. PATENT DOCUMENTS

| | | | |
|---|---|---|---|
| 2,636,986 | 4/1953 | Riderman | 343/895 |
| 2,824,306 | 2/1958 | Pfaff | 343/788 |
| 2,981,950 | 4/1961 | Skidmore | 343/788 |
| 3,823,403 | 7/1974 | Walter et al. | 343/708 |

*Primary Examiner*—Alfred E. Smith
*Assistant Examiner*—David K. Moore
*Attorney, Agent, or Firm*—Nathan Edelberg; Robert P. Gibson; Saul Elbaum

[57] ABSTRACT

An electrically small antenna designed for operation in the 25 to 50 megahertz frequency range which may be constructed in two basic forms. The first embodiment comprises a conductive coil in the form of a copper ribbon that is electroless-plated on a thin cylindrical silicone fiberglass substrate which is loaded with a ferrite core. The loaded coil assembly comprises a radiating element that operates over a metal ground plane. The second embodiment comprises a coiled ribbon conductor which is electroless copper plated directly on a cylindrical ferrite rod surface. The latter embodiment provides closer coupling of the magnetic field into the ferrite. Each embodiment preferably utilizes variable input and output capacitors which are respectively coupled to a source of RF power and to the ground plane.

7 Claims, 4 Drawing Figures

FIG. 1.
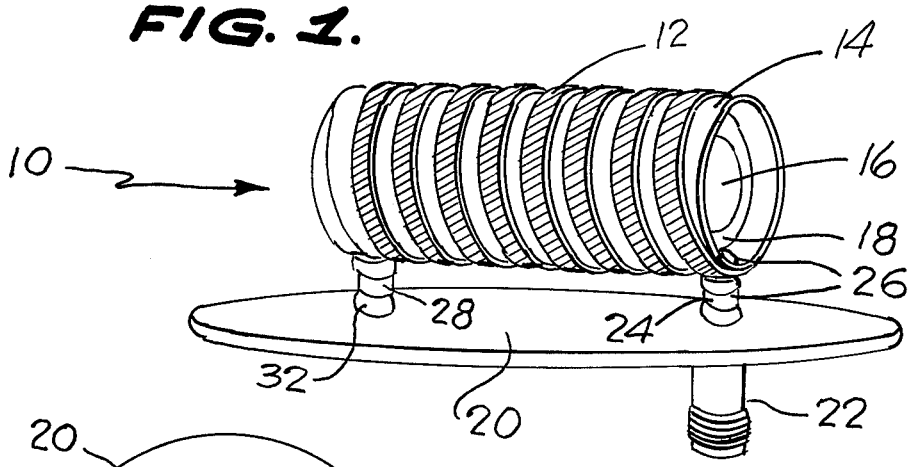
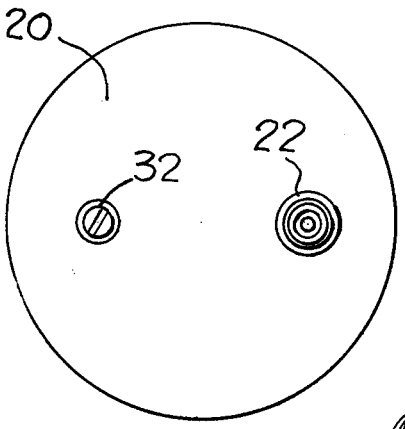
FIG. 2.
FIG. 3.
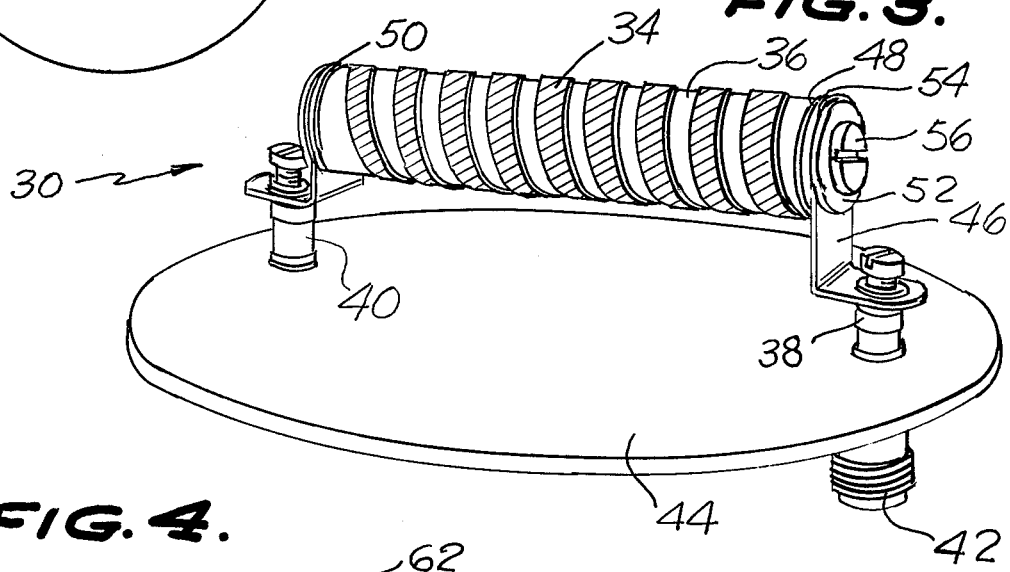
FIG. 4.
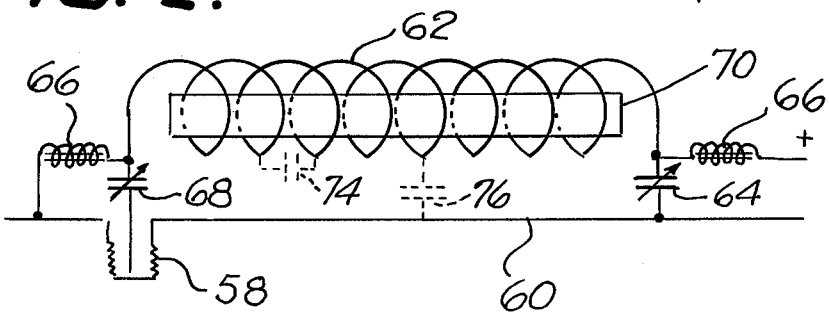

COMPACT LOW-PROFILE ELECTRICALLY SMALL VHF ANTENNA

BACKGROUND OF THE INVENTION

1. FIELD OF THE INVENTION

The present invention is related to antennas and, more particularly, is directed towards a compact low profile electrically small antenna designed primarily for operation in the lower VHF range.

2. DESCRIPTION OF THE PRIOR ART

Antennas in the form of multi-turn conductors arranged over ground planes and designed to operate in the UHF and VHF regions are well known. Conventional designs utilize, for example, air-filled coiled copper wire of various diameters wound in a multiple turn configuration whose resonant frequency depends upon the overall length and the number of turns in the coil. The chief advantages of multi-turn conducting radiators is that they may be made electrically small for use in the desired frequency ranges.

Prior art United States patents of which we are aware which describe typical multi-turn antenna radiators include: U.S. Pat. Nos. 3,573,840; 3,523,251; 3,503,075; 2,963,704; and 3,683,393.

U.S. Pat. No. 3,823,403 to Walter et al is illustrative of the combination of a multi-turn loop antenna radiating over a ground plane in which, however, the loop antenna consists of a coiled copper wire, a design which is bulky and requires a great deal of space for installation. In this class of structures also belongs that set forth in U.S. Pat. No. 3,965,474 to Guerrino et al in which a loop antenna of the copper wire variety is shown wound on a ferrite core. The structure described in the last-cited patent is also quite bulky and space consuming, making it inappropriate for many designs where space considerations are paramount.

OBJECTS AND SUMMARY OF THE INVENTION

It is therefore a primary object of the present invention to provide a compact low-profile electrically small antenna designed for operation in the UHF-VHF ranges, which overcomes all of the deficiencies noted above with respect to prior art structures.

Another object of the present invention is to provide a multi-turn conductor antenna structure which is both physically and electrically small and which may be easily and simply designed and fabricated.

An additional object of the present invention is to provide a multi-turn ribbon loop antenna structure which is both electrically and physically small to enable utilization in those applications where space is at a premium.

Another object of this invention is to provide a mechanically, electrically or magnetically tuned antenna structure.

The foregoing and other objects are attained in accordance with one aspect of the present invention through the provision of a compact electrically small antenna, which comprises a substantially cylindrical substrate, multi-turn conductor means coiled about the cylindrical substrate, a ground plane over which the cylindrical substrate is mounted, and ferrite means for loading the multi-turn conductor means. More particularly, the multi-turn conductor means comprises a conducting ribbon copperplated about the outer surface of the cylindrical substrate. In one embodiment, the cylindrical substrate comprises a thin tubular member composed of a dielectric material such as silicone fiberglass. Positioned coaxially within the tubular member is a ferrite rod about a dielectric sleeve may be formed for mounting same within the tubular substrate. One end of the conducting ribbon is connected through a variable capacitance means to a source of RF power, the distal end thereof being connected also through a variable capacitor to the ground plane.

In accordance with another aspect of the present invention, the cylindrical substrate may be comprised of a substantially cylindrical ferrite rod about the outer surface of which the multi-turn conductor may be directly plated.

BRIEF DESCRIPTION OF THE DRAWINGS

Various objects, features and attendant advantages of the present invention will be more fully appreciated as the same become better understood from the following detailed description thereof when considered in connection with the accompanying drawings, in which:

FIG. 1 is a perspective view which illustrates one preferred embodiment of the antenna structure in accordance with the present invention;

FIG. 2 is a plan view of the underside of the preferred embodiment illustrated in FIG. 1;

FIG. 3 is a perspective view of a second and alternative embodiment of an antenna structure in accordance with the teachings of the present invention; and FIG. 4 is a schematic diagram illustrating the equivalent circuit components of the antenna structure of the present invention.

DETAILED DESCRIPTION OF THE PREFERRED EMBODIMENTS

Referring now to the drawings, wherein like reference numerals indicate identical or corresponding parts throughout the several views, and more particularly to FIGS. 1 and 2 thereof, there is illustrated a first preferred embodiment of a compact low-profile electrically small antenna designed primarily for operation in the VHF range and which is indicated generally by reference numeral 10.

The antenna 10 is comprised of an electrically conductive multi-turn magnetic loop 12. The magnetic loop 12 is arranged in the form of a coiled conductive ribbon which may, for example, be electroless copperplated on a thin dielectric sleeve or substrate 14. In a preferred mode, the substrate 14 comprises a thin tubular member of silicone fiberglass, on the order of 1/32 inch thick, and the copperplated ribbon 12 is formed about the silicone fiberglass sleeve 14 in eight turns and has a thickness of approximately 0.005 inches.

The cylindrical sleeve 14 is loaded with a ferrite core or rod 16 positioned coaxially therewithin. The ferrite core or rod 16 is supported in place within sleeve 14 by a tubular rod sleeve 18 of a dielectric material which may be formed, for example, of a polystyrene foam. In the preferred mode, the ferrite core 16 is approximately 1 inch in diameter and may be comprised of, for example, a Ferramic Q-3 polycrystalline ferrite material having an approximate permeability of 12, a dielectric constant of about 12, and a loss tangent equal to 0.0004.

The above-described radiating elements are mounted over a metal ground plane 20. The input end of the coil 12 is preferably fed through ground plane 20 by an RF input connector 22 connected to an appropriate source of RF power (not shown). A tunable input capacitor 24 is preferably inserted between the input connector 22 and the input end of coil 12, conventional coupling means 26 being employed. Input capacitor 24 is provided for impedance matching the antenna to the source of RF power.

The other end of the coil 12 is terminated to the ground plane 20 through a tunable output capacitor 28 which is connected to ground 20 via a connector 32. The output capacitor 28 is provided for the purposes of tuning the resonant frequency of the antenna 10, in a manner to be described in more detail hereinafter.

Referring now to FIG. 3, reference numeral 30 indicates generally a second and alternative embodiment of the present invention wherein a coiled ribbon conductor 34 is electroless copperplated directly on the outer surface of a cylindrical ferrite rod 36. This construction provides a closer coupling of the magnetic field into the ferrite. A variable input capacitor 38 may be provided, as well as a tunable output capacitor 40. The antenna structure 30 radiates over a metal ground plate 44 having an RF input feed 42 extending therethrough to the input capacitor 38. A metallic conducting bracket 46 connects the input capacitor 38 to the metal coated end 48 of ferrite rod 36. Bracket 46 may be held in place via a pair of metallic washers 52 and 54, or the like, the entire assembly being secured by a nonconductive threaded screw means 56. A similar structure obtains at the output end 50 of the antenna 30.

Both of the embodiments illustrated in FIGS. 1 and 3 are resonant, in their preferred modes, in the 50 megahertz range. The first embodiment, illustrated in FIG. 1, without the loading provided by ferrite rod 16 is resonant at about 95 megahertz.

A schematic circuit representation of the antenna elements is illustrated in FIG. 4 to which attention is now directed. The reference numerals indicate schematically the RF input 58, the metallic ground plane 60, the multi-turn loop coil 62 within which is positioned the ferrite core 70. Reference numerals 74 and 76 indicate respectively the stray shunt capacitances associated with the multi-turn inductor 62 and the metallic ground plane 60.

As described hereinabove, the tunable input capacitor 68 is used for impedance matching the antenna 62 to the RF source in order to tune out the inductive reactance of loop 62.

The resonant frequency of the antenna structure illustrated schematically in FIG. 4 may be tuned in either of three alternative manners. Firstly, the antenna may be mechanically tuned by adjusting the position of the ferrite core 70 within the multi-turn inductor 62, by adjusting the series capacitor 64 at the terminating end, or by mechanically changing a magnetic bias field (not shown) in proximity with the ferrite core 70.

Secondly, the antenna may be electrically tuned by, for example, replacing the series capacitor 64 at the terminating end with a semiconductor varactor diode and applying a DC bias voltage across the varactor through an isolating RF choke 66.

Thirdly and alternatively, the antenna of the present invention may be magnetically tuned by magnetizing the ferrite loading material 70 with a DC bias voltage applied to the multi-turn inductor 62 through an isolating RF choke 66.

It may be appreciated from the foregoing that the radiator of the present invention may be extremely useful as a sensor antenna as a result of its small size, low profile, and compactness for operation in the lower VHF range. Such features also render the instant invention particularly applicable in those situations where physically small antennas are required, such as in vehicular communications antennas, manpacks, space craft, and weaponry.

Obviously, numerous modifications and variations of the present invention are possible in light of the above teachings. It is therefore to be understood that within the scope of the appended claims, the invention may be practiced otherwise than as specifically described herein.

We claim as our invention:

1. A compact low-profile electrically small antenna, which comprises:

a substantially cylindrical substrate, wherein said cylindrical substrate comprises a tubular member composed of a dielectric material;

multi-turn conductor means coiled about said cylindrical substrate, wherein said multi-turn conductor means comprises a conducting ribbon copperplated about the outer surface of said cylindrical substrate;

a ground plane over which said cylindrical substrate is mounted;

ferrite means for loading and tuning said multi-turn conductor means, wherein said ferrite means comprises a ferrite rod positioned coaxially within said tubular member; and a tubular rod sleeve of a dielectric material means surrounding said ferrite rod for supporting same within said tubular member.

2. The compact electrically small antenna as set forth in claim 1, wherein said tubular member's dielectric material comprises silicone fiberglass.

3. The compact electrically small antenna as set forth in claim 1, wherein one end of said conducting ribbon is connected to a source of RF power, the distal end of said ribbon being connected to said ground plane.

4. The compact electrically small antenna as set forth in claim 3, further comprising first and second tunable capacitance means disposed respectively between said RF power source and said one end, and between said distal end and said ground plane.

5. The compact electrically small antenna as set forth in claim 1, further comprising means for mechanically tuning the resonant frequency of said antenna.

6. The compact electrically small antenna as set forth in claim 1, further comprising means for electrically tuning the resonant frequency of said antenna.

7. The compact electrically small antenna as set forth in claim 1, further comprising means for magnetically tuning the resonant frequency of said antenna.

* * * * *